United States Patent [19]

Mattheck

[11] Patent Number: 4,733,647

[45] Date of Patent: Mar. 29, 1988

[54] BOW HAVING LIMBS WITH FORKS THAT ARE FASTENED TO A HANDLE

[75] Inventor: Claus Mattheck, Leimersheim, Fed. Rep. of Germany

[73] Assignee: Kernforschungszentrum Karlsruhe GmbH, Karlsruhe, Fed. Rep. of Germany

[21] Appl. No.: 782,609

[22] Filed: Oct. 1, 1985

[30] Foreign Application Priority Data

Jan. 26, 1985 [DE] Fed. Rep. of Germany ..... 3502617

[51] Int. Cl.[4] ..... F41B 5/00

[52] U.S. Cl. ..... 124/23 R; 124/88

[58] Field of Search ..... 124/23 R, 25, 88, 86, 124/89, 35, 41

[56] References Cited

U.S. PATENT DOCUMENTS 2,736,309 2/1956 Hoffman ..... 124/23 R 3,434,465 3/1969 Stewart ..... 124/23 R 3,674,001 4/1972 Hih ..... 124/88

FOREIGN PATENT DOCUMENTS 2304819 8/1974 Fed. Rep. of Germany .... 124/23 R

*Primary Examiner*—Richard C. Pinkham

*Assistant Examiner*—Gary Jackson

*Attorney, Agent, or Firm*—Spencer & Frank

[57] ABSTRACT

A bow includes a centrally arranged handle and a bow limb emanating from each end of the handle, with a cord being tensioned between the outer ends of the bow limbs. The inner ends of the bow limbs are shaped into forks whose tines (which act as springs) are fastened separately, each to a frontal face of the handle. The special configuration increases the energy stored in the bow and reduces the force required for tensioning the cord.

7 Claims, 5 Drawing Figures

BOW HAVING LIMBS WITH FORKS THAT ARE FASTENED TO A HANDLE

BACKGROUND OF THE INVENTION

The present invention relates to a bow having a holding grip arranged in its center and having a cord or bow string.

Such bows are used for sports purposes and require repeated actuation. This actuation requires a large amount of physical strength which cannot be reduced or avoided by simple reduction of the tension force since such a measure would adversely affect the path of flight of the arrow.

SUMMARY OF THE INVENTION

It is an object of the present invention to modify a bow of the above-mentioned type by giving it such a configuration that the energy stored in the bow is increased or, if no more energy is wanted, the amount of force required to tension the cord is reduced.

This increase in energy storage is realized by the present invention in that one limb of the bow emanates to each side of the handle, with a cord being tensioned between one end of each limb and the other end of each limb being shaped into a fork having two line springs. The tines of the fork are separately fastened, each to a frontal face of the handle.

DESCRIPTION OF THE PREFERRED EMBODIMENT

Figure 1:
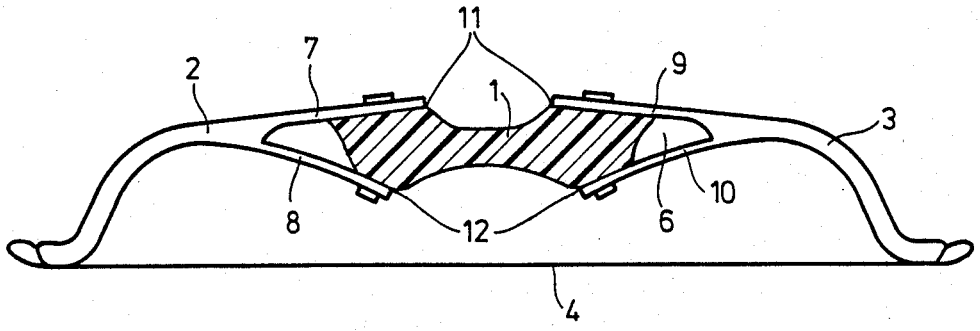
FIGS. 1 and 2 are side views of two bows of the present invention in their untensioned or undrawn state.

FIG. 1 shows the bow of the present invention in the untensioned state. The central handle 1 arranged in the center of the bow is supplemented at both sides by means of identical bow limbs 2 and 3 to form the total bow. The bow string or cord 4 is tensioned between the two free ends of bow limbs 2 and 3. Bow limbs 2 and 3 are shaped into forks 5 and 6 whose tines (springs) 7, 8 and 9, 10, respectively, are each fastened (screwed, glued, etc.) to one of frontal faces 11 and 12, respectively of handle 1. Forks 5 and 6 have such a configuration that a free region remains with respect to handle 1 when the bow is in the untensioned state.

Figure 3:
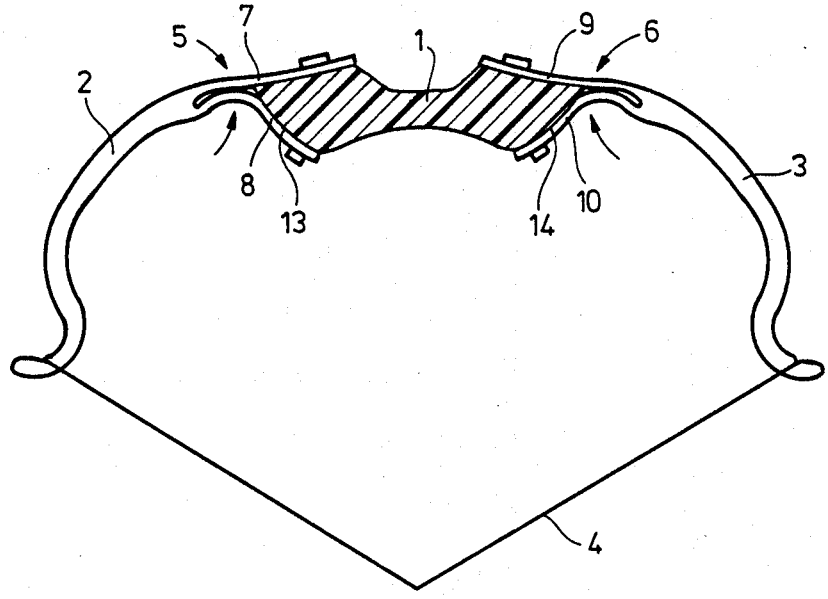
FIG. 3 is a side view illustrating the bow of FIG. 1 in its tensioned or drawn state.
Figure 4:
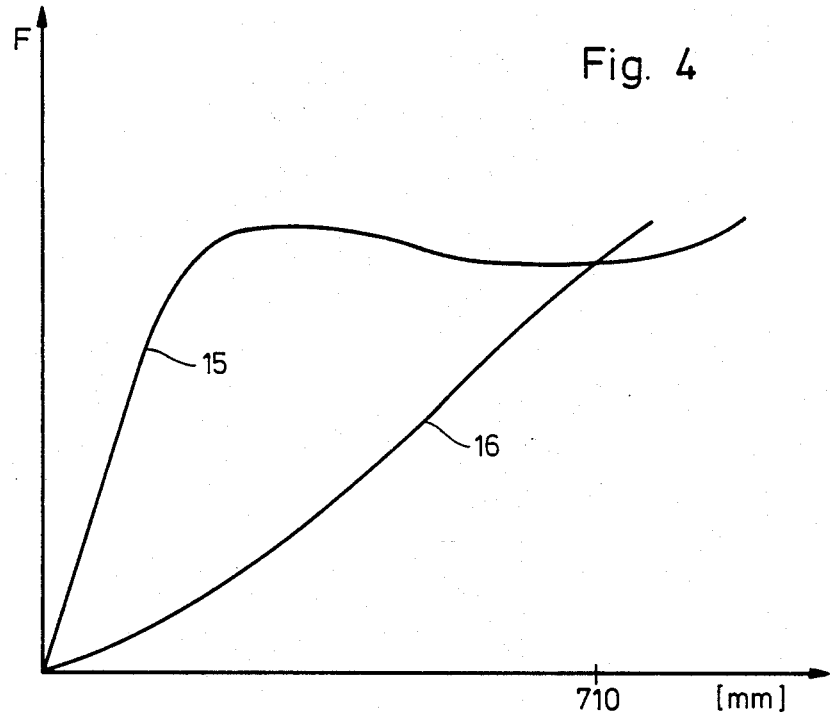
FIG. 4 is a graph comparing force with respect to draw distance for the bow of FIG. 1 or 2 and for a conventional recurve bow of the same draw weight.

If cord 4 in the bow of FIG. 1 is tensioned, a state results as shown in FIG. 3. Tines (springs) 8 and 10 of the two forks 5 and 6 rest against surfaces 13 and 14 of handle 1 or against each other and thus are bent over until they are in approximate contact with the corresponding tines 7 and 9. This measure causes the bow to have a non-linear gain in potential energy as shown in FIG. 4 by curve 15 in the force (F) over draw (x in mm) diagram. The force draw curve 16 of the prior art recurved bow is shown for comparison, thus illustrating the energy gain.

Figure 5:
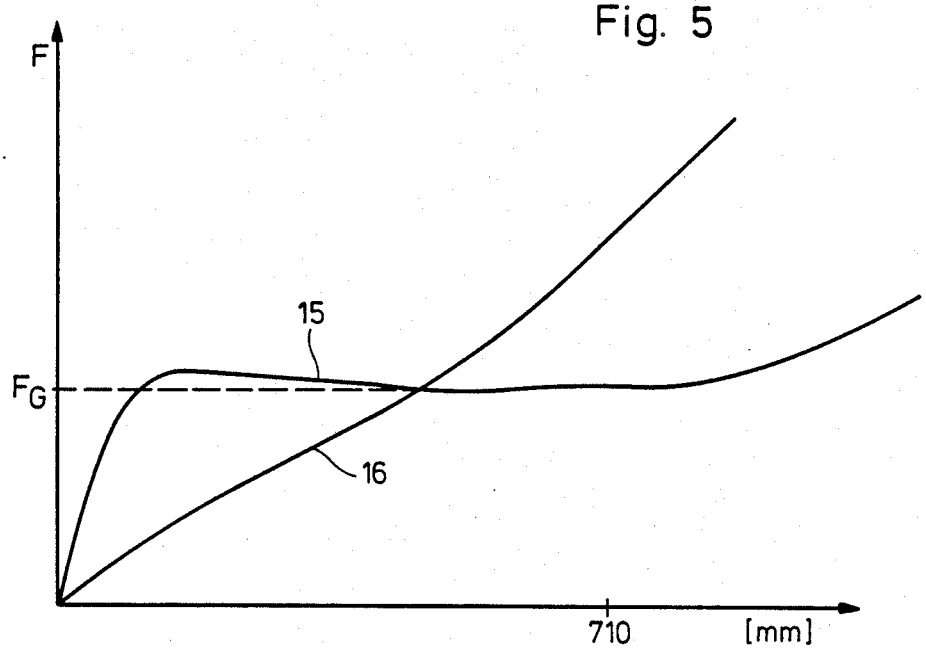
FIG. 5 is a graph comparing force with respect to pull-out distance when the cords of the bow of FIG. 1 and a conventional bow are tensioned.

FIG. 5 shows the force draw curves 15 and 16, but this time with the same energy storage as a related traditional recurve bow. It can be seen clearly that beginning with a certain limit force $F_G$, the bow according to the present invention results in a reduction in the required force, without any loss of energy.

In the bow of FIG. 1 the outer frontal faces 11 are preferably either flat or slightly concave and the inner frontal faces 12 are preferably either flat or convex. The surfaces 13 and 14 are preferably concave and merge smoothly with the respective inner frontal face 12. Outer tines 7 and 9 are preferably broadened at the bases of forks 5 and 6, respectively (that is, where tine 7 joins tine 8 and where tine 9 joins tine 10), but tines 8 and 10 preferably have uniform cross-sections from the base of the respective fork 5 or 6 to the respective face 12. When the bow is in its untensioned state, the portions of tines 8 and 10 that are not in contact with surfaces 13 and 4, respectively, are considerably longer than surfaces 13 and 14, respectively, which are in turn approximately as long as the portions of tines 7 and 9 that are not in contact with the respective face 11.

Figure 2:
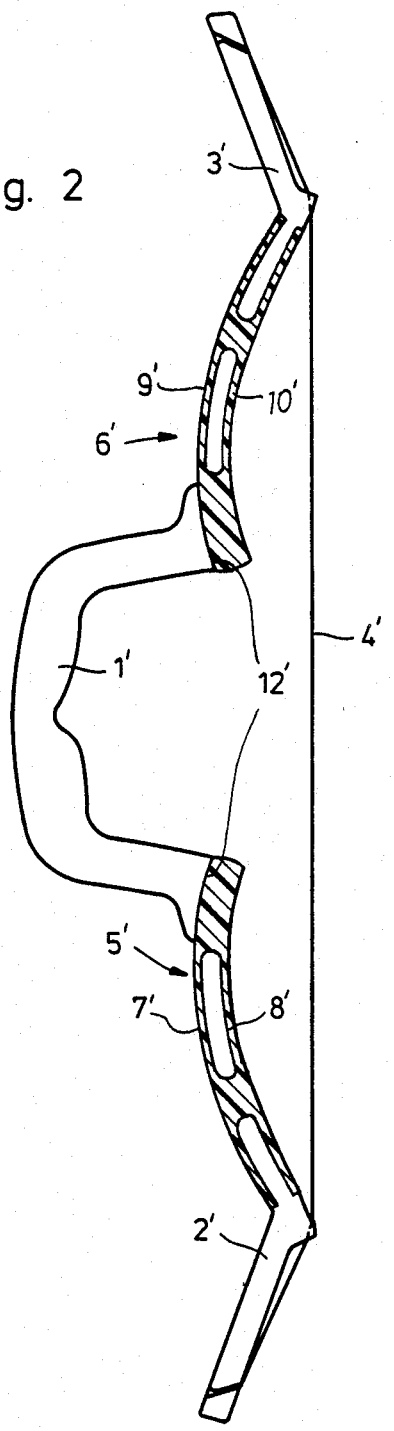

In the embodiment shown in FIG. 2, a central handle 1' arranged in the center of the bow is supplemented at both sides by means of identical bow limbs 2' and 3' to form the total bow. The bow string or cord 4' is tensioned between the two free ends of bow limbs 2' and 3'. Bow limbs 2' and 3' are shaped into forks 5' and 6' whose tines (springs) 7', 8' and 9', 10', respectively, are each fastened (screwed, glued, etc.) to frontal faces 12' of handle 1'.

In the case of the advanced bow of FIG. 2 the tines (springs) 7'–10' approach each other when the bow is drawn, and tines 8 and 10 do not rest against handle 1. The force-draw curve of this more optimized example (FIG. 2) is similar to that sketched in FIGS. 4, 5.

It will be understood that the above description of the present invention is susceptible to various modifications, changes and adaptations, and the same are intended to be comprehended within the meaning and range of equivalents of the appended claims.

What is claimed is:

1. A bow for use with a cord or in crossbows, comprising:

a handle having two ends; and a pair of bow limbs, each bow limb emanating from a respective end of said handle and including a first end and a second end having a pair of tines acting as springs, a substantial portion of the tines being unconnected, each bow limb additionally including a respective tine-integral portion to which the respective tines are affixed, said tine-integral portions being spaced apart from said handle, said second ends of said bow limbs being fastened to the handle, and said cord being tensioned between said first ends of said bow limbs.

2. The bow of claim 1, wherein one tine of each bow limb faces the cord, and wherein said handle additionally has a pair of outer surface portions, each outer surface portion being disposed adjacent a respective end of said handle, and is shaped in such a manner that the tines facing said cord rest against said outer surface portions when the bow limbs are tensioned.

3. The bow of claim 1, wherein the cord has a central portion, wherein the second end of each bow limb additionally includes a respective further tine-integral portion which is disposed between said central portion of the cord and said handle, and wherein the further tine integral portions are attached to said handle.

4. The bow of claim 1, wherein said handle has a pair of surface portions and two pairs of frontal faces, each surface portion being disposed adjacent a respective end of said handle between a respective pair of frontal faces; wherein the second ends of said bow limbs are shaped as forks and the tines of each bow limb are separately fastened to respective frontal faces, with one tine of each fork facing the cord; and wherein said surface portions of said handle are shaped in such a manner that the tines facing said cord rest against said surface portions when the bow limbs are tensioned.

5. The bow of claim 1, wherein said handle has a pair of outer frontal faces, each outer frontal face being disposed adjacent a respective end of said handle; wherein each bow limb further includes means at the second end thereof for connecting the tines of the bow limb to one another at a position spaced apart from the respective tine-integral portion, and wherein each means at the second end is attached to a respective outer frontal face.

6. The bow of claim 1, wherein each bow limb, and the tines and tine integral portion thereof, is a unitary element.

7. The bow limb of claim 1, wherein said handle has a back side facing the cord and a front side facing away from the cord, wherein one tine of each bow limb faces the cord, and wherein each bow limb comprises means for bending the tines which face the cord toward the front side of the handle as the cord is tensioned.

* * * * *